United States Patent [19]

Abrams et al.

[11] 4,139,936

[45] Feb. 20, 1979

[54] METHOD OF MAKING HERMETIC COAXIAL CABLE

[75] Inventors: Richard L. Abrams; Douglas A. Pinnow, both of Pacific Palisades, Calif.

[73] Assignee: Hughes Aircraft Company, Culver City, Calif.

[21] Appl. No.: 813,195

[22] Filed: Jul. 5, 1977

[51] Int. Cl.[2] ..... H01B 13/22

[52] U.S. Cl. ..... 29/624; 29/420.5; 29/527.4; 156/47; 174/102 C; 428/539.5

[58] Field of Search ..... 29/624, 527.4, 420.5; 174/102 C, 102 P, 102 SC, 119 C, 126 C; 156/47, 48, 50, 51; 427/117, 118, 120, 123, 125; 428/539.5

[56] References Cited

U.S. PATENT DOCUMENTS

| | | | |
|---|---|---|---|
| 201,477 | 3/1878 | Alberger | 156/50 |
| 220,907 | 10/1879 | Arbogast | 427/117 X |
| 2,211,584 | 8/1940 | Ruben | 174/102 C |
| 2,587,916 | 3/1952 | Squier | 174/102 P |
| 2,888,740 | 6/1959 | Danis | 29/420.5 X |
| 3,922,769 | 12/1975 | Brehan | 29/624 |

FOREIGN PATENT DOCUMENTS

| | | | |
|---|---|---|---|
| 469145 | 7/1975 | U.S.S.R. | 427/120 |

*Primary Examiner*—Carl E. Hall

*Attorney, Agent, or Firm*—John Holtrichter, Jr.; W. H. MacAllister

[57] ABSTRACT

There is described a hermetic coaxial cable particularly adapted to be produced in miniature form and having a completely solid cross section with a solid metal central conductor, a tubular metal outer conductor, and a continuous glass dielectric insulator therebetween.

2 Claims, 6 Drawing Figures

Fig. 1.
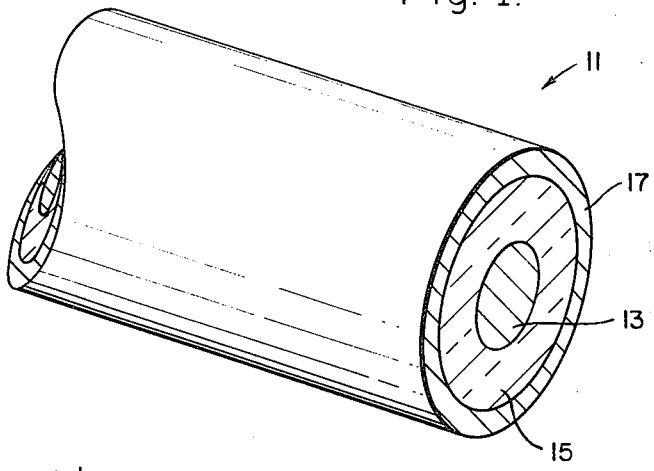
Fig. 2.
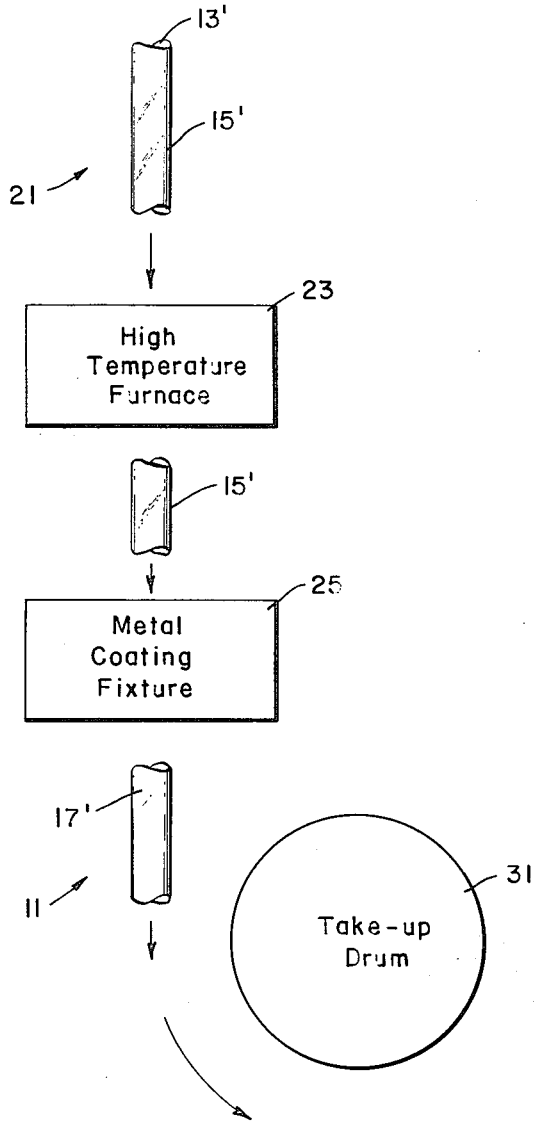
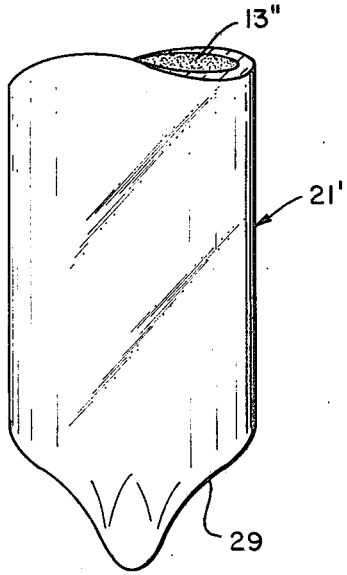
Fig. 3.

Fig. 5.
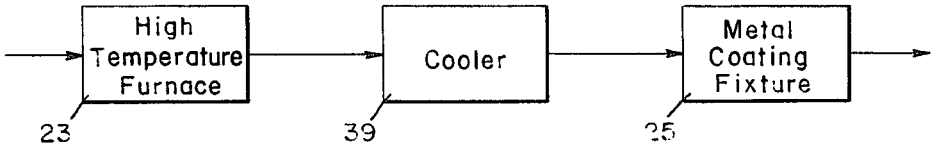
Fig. 4.
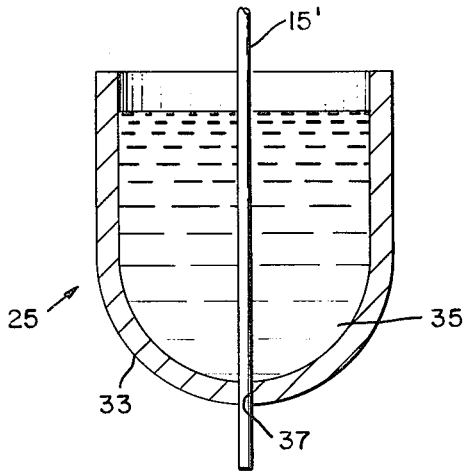
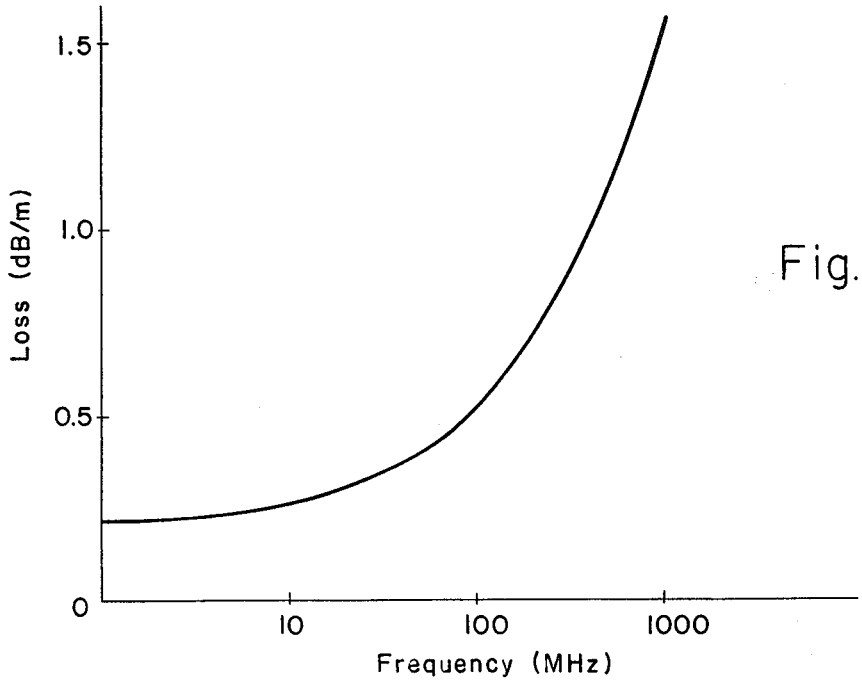
Fig. 6.

METHOD OF MAKING HERMETIC COAXIAL CABLE

BACKGROUND OF THE INVENTION

The background of the invention will be set forth in two parts.

1. Field of the Invention

This invention relates generally to transmission lines of radio frequency energy, and more particularly to coaxial cable type transmission lines.

2. Description of the Prior Art

Transmission lines of the coaxial type having long been known for their advantageous qualities such as the capability of generating no external field, and having no susceptibility to external fields from other sources.

A coaxial line is generally defined as a two conductor transmission line in which one conductor completely surrounds the other, the two being coaxial and separated by either a continuous solid dielectric material or by dielectric spacers with an inert gas as the principal insulating material. The latter type lines are generally expensive to manufacture and are of relatively large diameter in order to accomodate the distribution of the spacers uniformly throughout the length of the line. On the other hand, the solid dielectric type coaxial lines are relatively easily manufactured, even in small diameter sizes, but generally have a higher loss factor than those lines utilizing disk or bead dielectric spacers.

An important factor in evaluating both basic types of coaxial lines is that of their immunity from moisture contamination. The introduction of moisture between the two conductors of a coaxial line will greatly affect important propagation characteristics of the line. This problem is usually not a factor with gas-filled lines because the gas is under pressure and is necessarily hermetically sealed at its ends in order to maintain gas pressure.

However, solid dielectric coaxial lines are ordinarily provided with a braided metal wire outer conductor and are, therefore, susceptible to moisture contamination unless a special moisture-tight cover or jacket can be provided over the braid. Not only does the jacket add greatly to the cost and size of the cable, but they are generally only useful for a short time, and they are not hermetic. Eventually these covers will pass moisture. Also, these covers do not solve the inherent problem of field leakage involved in the use of a braided outer conductor in place of a solid outer conductor. In other words, braided outer conductor coaxial lines are generally more susceptible to problems involving external RF fields than coaxial lines having solid outer conductors.

There are also other applications where the smallness of the solid dielectric type lines are required, but requiring the complete and dependable freedom from moisture contamination found in gas-filled, segmented spacer type coax. One example of such a requirement would be in applications requiring hermetic RF feedthrough, such as used to bring a high speed electrical signal from a cooled photodetector inside a dewar to external circuitry. Presently, there are no relatively small diameter, solid dielectric hermetic coaxial cables available.

SUMMARY OF THE INVENTION

In view of the foregoing factors and conditions characteristic of the prior art, it is a primary object of the present invention to provide an improved solid dielectric coaxial cable.

Another object of the present invention is to provide a hermetic coaxial cable.

Still another object of the present invention is to provide a relatively small diameter, solid dielectric coaxial cable that is impervious to moisture contamination and not susceptible to influence from external fields.

Yet another object of the present invention is to provide a hermetic, solid core, coaxial cable that has a relatively wide operational temperature range.

In accordance with one embodiment of the present invention, a coaxial cable is provided having a solid central conductor uniformly surrounded by a continuous solid glass dielectric by drawing a preform through a furnace, the preform being hollow glass tubing filled with a metal having a melting temperature lower than the softening temperature of the glass tubing. A solid outer conductor is coaxially disposed about the central conductor on the glass insulator by passing the glass-surrounded central conductor down through a metal coating cup.

The features of the present invention which are believed to be novel are set forth with particularity in the appended claims. The present invention, both as to its organization and manner of operation, together with further objects and advantages thereof, may best be understood by referring to the following description, taken in conjunction with the accompanying drawing, in which like reference characters refer to like elements in the several views.

BRIEF DESCRIPTION OF THE DRAWING

FIG. 1 is an enlarged perspective view, partially in section, of a hermetic coaxial cable constructed in accordance with the present invention;

FIG. 2 is a block diagram showing one method of fabricating the hermetic coaxial cable illustrated in FIG. 1;

FIG. 3 is an enlarged perspective view, partially in section, of an end portion of a preform used in accordance with an embodiment of the invention;

FIG. 4 is a sectioned, elevational view of a metal coating fixture constructed in accordance with still another embodiment of the invention;

FIG. 5 is a block diagram of another method of providing the hermetic coaxial cable in accordance with this invention; and FIG. 6 is a graph illustrating a comparison of transmission loss as a function of frequency.

DESCRIPTION OF THE PREFERRED EMBODIMENTS

Referring now to the drawing, and more particularly to FIG. 1, there is shown a hermetic coaxial cable 11 having a solid central conductor 13, a glass cladding 15 concentrically surrounding the central conductor 13, and a metallic coating or jacket 17 concentrically surrounding the glass cladding 15. The central conductor 13 and the jacket 17 are preferably of a material, or materials, having a relatively high conductivity, such as, for example, silver, gold, copper and aluminum, and the glass cladding 15 may be of $SiO_2$, or any suitable glass material having a relatively low conductivity.

In accordance with a preferred technique for fabricating the cable 11, illustrated in FIG. 2, a preform 21, comprising a glass-clad fine metal wire 13', is heated in a conventional high temperature furnace 23, such as a resistance furnace, for example, and drawn to a smaller diameter before passing a metal coating fixture 25 which introduces a conductive metal 17' such as aluminum, in its molten state, to the outer surface of the drawn glass cladding 15' to produce the finished product 11.

Alternately, the preform 21 may take the form of hollow glass tubing 21' which is sealed at its lower end 29 and filled with metal particles 13'' which have a melting point below the softening point of the glass tubing 21', as shown in FIG. 3. In accordance with this technique, the preform 21' is slowly passed through the furnace 23 so as to soften the glass and completely melt the metal core. A small filament of the soft glass is then drawn from the furnace and passed to the metal coating fixture 25 to provide the outer conductor 17. The finished product may then be attached to a rotating take-up drum 31, for example (see FIG. 2).

Referring to FIG. 4, the metal coating fixture may take the form of a small platinum bowl 33 which contains a molten aluminum 35. This container includes a hole 37 in its bottom large enough to pass the drawn fiber 15' but sufficiently small so that the surface tension of the molten metal prevents the metal from running out of the cup. Of course, other well known techniques may be utilized in place of the bowl 33 to coat the drawn fiber 15'.

It has been found to be highly desirable to coat the outer surface of the glass filament 15' with metal as it is being drawn in order to achieve the highest possible strength. Tensile strength for silica fibers of 500,000 to 850,000 psi have been achieved by coating them with a 20 μm thick layer of aluminum metal; and, in accordance with still another embodiment of the invention, a conventional cooling fixture 39 is disposed immediately adjacent the output end of the furnace 23 in order to quickly cool the drawn glass filament 15' just prior to the metal coating process, as illustrated in FIG. 5.

A wide selection of metals and glasses may be used in the fabrication of the coaxial cable 11. However, to optimize the electrical characteristics it is desirable to select metals with low resistivities such as silver, gold, copper and aluminum and a glass with a low dielectric loss tangent, such as pure silica. It is important to note that the dielectric loss tangent of pure silica is lower than that of polyethylene and comparable to that of teflon; the most common dielectric materials used in the production of commercial coaxial cable.

The preformance of coaxial cable constructed in accordance with the invention may be calculated from well known engineering design data listed in such references as the American Institute of Physics Handbook, 2nd Edition, McGraw Hill, NY 1963, pp 5-47 to 5-56 and pp 5-158 to 5-161. For example, the characteristic impedance of a small diameter coaxial cable with a solid silicon dielectric is:

$$Z_o(\text{ohms}) = 116 \text{ In } \left(\frac{r_o}{r_i}\right),$$

where $r_o$ and $r_i$ are the radii of the outer and inner conductors, as shown in FIG. 1. The resistance per unit length is:

$$R = \frac{R_s}{2\pi}\left(\frac{1}{r_o} + \frac{1}{r_i}\right), \text{ where}$$

$R_s$ is the skin resistance of the metal conductors. The transmission loss for such cable is:

$$\alpha(dB/m) = 8.68 \frac{R}{2Z_o}.$$

From the above equations it can be determined that both a large $r_i$ and a large ratio of $r_o/r_i$ are desirable for low transmission loss. However, a small $r_o$ is desirable for good mechanical flexibility of the cable. A reasonable trade-off would be a cable with a 20 μm copper core radius, a silica dielectric 150 μm in radius coated with a 20 μm thick aluminum outer jacket. This cable could be bent to a radius of approximately 3 mm without breaking. The cable would have a characteristic impedance of approximately 233 ohms and its electrical resistance would be dominated by the 20 μm copper core. At frequencies up to about 10 MHz, the core would have a resistance of 12 ohms/m.

Table I shows that at frequencies about 10 MHz, the skin depth of copper becomes less than the 20 μm radius of the inner conductor. This results in increased electrical resistance and increased transmission loss. FIG. 6 is a plot of the transmission loss as a function of frequency. These characteristics should be quite satisfactory for a number of applications including hermetic RF feedthroughs in dewar systems, for example.

TABLE I

| Frequency (MHz) | Skin Depth of Copper (μm) |
|---|---|
| 10 | 20 |
| 100 | 6 |
| 1,000 | 2 |

From the foregoing, it should be evident that there has herein been described a hermetic coaxial cable that exhibits desirable characteristics and is easily fabricated in accordance with several method embodiments of the invention.

It should also be understood that the materials described in detail with respect to the various embodiments of the present invention are not considered critical, and any materials exhibiting similar desired characteristics may be substituted for those specifically mentioned.

Although the present invention has been shown and described with reference to particular embodiments, nevertheless, various changes and modifications which are obvious to persons skilled in the art to which the invention pertains are deemed to lie within the spirit, scope and contemplation of the invention.

What is claimed is:

1. The method of fabricating coaxial cable having a solid metal central core and a tubular outer conductor and having a continuous glass dielectric insulator therebetween, comprising the steps of:

sealing the lower end of a length of glass tubing;

providing a preform by disposing within the hollow core of said glass tubing, metal particles having a melting temperature lower than the softening temperature of the glass tubing;

providing a metal-filled glass filament by heating said preform in a furnace to melt the metal particles and soften the glass tubing;

cooling said metal-filled glass filament to solidify said metal; and depositing a metal coating on said glass filament by passing said soft glass filament down through a metal coating cup.

2. The method of fabricating coaxial cable having a solid metal central core and tubular outer conductor and having a continuous glass dielectric insulator therebetween, comprising the steps of:

sealing the lower end of a length of glass tubing;

providing a preform by disposing within the hollow core of said glass tubing, metal particles having a melting temperature lower than the softening temperature of said glass tubing;

providing a metal-filled glass filament by heating said preform in a furnace to melt the metal particles and soften said glass tubing; and depositing a metal coating on said glass filament by passing said soft glass filament down through a metal coating cup.

* * * * *